US006998985B2

(12) United States Patent
Reisman et al.

(10) Patent No.: US 6,998,985 B2
(45) Date of Patent: Feb. 14, 2006

(54) MONITORING AND TRACKING NETWORK

(75) Inventors: Yoav Reisman, Ra'annana (IL); Gil Gemer, Nirit (IL); Guy Greitser, Haifa (IL); Natan Galperin, Zoran (IL); Dan Zeeli, Rishon Le-Zion (IL)

(73) Assignee: DMATEK, Ltd., (IL)

( * ) Notice: Subject to any disclaimer, the term of this patent is extended or adjusted under 35 U.S.C. 154(b) by 0 days.

(21) Appl. No.: 10/378,663

(22) Filed: Mar. 5, 2003

(65) Prior Publication Data

US 2004/0174264 A1 Sep. 9, 2004

(51) Int. Cl.
*G08B 23/00* (2006.01)

(52) U.S. Cl. ..... 340/573.1; 340/539.13

(58) Field of Classification Search ..... 340/573.1, 340/573.4, 539.11, 539.12, 539.13, 825.49; 379/37, 38

See application file for complete search history.

(56) References Cited

U.S. PATENT DOCUMENTS

| | | | | |
|---|---|---|---|---|
| 3,506,791 A | | 4/1970 | Halaby | |
| 4,611,198 A | * | 9/1986 | Levinson et al. | 340/539.11 |
| 4,885,571 A | | 12/1989 | Pauley et al. | |
| 4,918,432 A | * | 4/1990 | Pauley et al. | 340/573.4 |
| 5,062,151 A | | 10/1991 | Shipley | |
| 5,218,344 A | | 6/1993 | Ricketts | |
| 5,396,227 A | | 3/1995 | Carroll et al. | |
| 5,461,390 A | * | 10/1995 | Hoshen | 340/573.4 |
| 5,512,879 A | | 4/1996 | Stokes | |
| 5,640,157 A | | 6/1997 | Langeraar | |
| 5,659,303 A | | 8/1997 | Adair, Jr. | |
| 5,731,757 A | | 3/1998 | Layson, Jr. | |
| 5,745,037 A | | 4/1998 | Guthrie et al. | |
| 5,796,827 A | | 8/1998 | Coppersmith et al. | |
| 5,867,103 A | * | 2/1999 | Taylor, Jr. | 340/573.4 |
| 5,870,029 A | | 2/1999 | Otto et al. | |
| 5,889,474 A | | 3/1999 | LaDue | |
| 5,892,441 A | | 4/1999 | Woolley et al. | |
| 5,959,533 A | | 9/1999 | Layson, Jr. et al. | |
| 6,072,396 A | * | 6/2000 | Gaukel | 340/573.4 |
| 6,208,247 B1 | | 3/2001 | Agre et al. | |
| 6,208,855 B1 | | 3/2001 | Tanaka | |
| 6,344,794 B1 | * | 2/2002 | Ulrich et al. | 340/539.13 |
| 6,373,389 B1 | | 4/2002 | Przygoda, Jr. et al. | |
| 6,639,516 B1 | * | 10/2003 | Copley | 340/573.4 |
| 6,774,797 B1 | * | 8/2004 | Freathy et al. | 340/573.1 |
| 2003/0197612 A1 | | 10/2003 | Tanaka et al. | |
| 2004/0077367 A1 | * | 4/2004 | Sama et al. | 455/518 |
| 2005/0029346 A1 | * | 2/2005 | Byrne et al. | 235/382 |

FOREIGN PATENT DOCUMENTS

GB 2 360 862 A 3/2001

(Continued)

OTHER PUBLICATIONS

European Search Report dated Nov. 11, 2004.

(Continued)

*Primary Examiner*—Thomas Mullen
(74) *Attorney, Agent, or Firm*—Nixon Peabody LLP; Jeffrey L. Costellia

(57) ABSTRACT

A monitoring and tracking system comprising a plurality of transmitting tags attachable to a plurality of monitored individuals, a plurality of monitoring devices and a central monitoring server. The transmitting tags, each having a unique code, periodically transmit data carrying signals, the signals are received by any of the local monitoring devices when a tag is within a reception range of a local monitoring device for allowing tracking the monitored individuals.

33 Claims, 7 Drawing Sheets

FOREIGN PATENT DOCUMENTS

| | | |
|---|---|---|
| JP | 2002-056366 | 2/2002 |
| JP | 2002-133039 | 5/2002 |
| JP | 2003-323490 | 11/2003 |
| WO | WO 99/023623 | 5/1999 |
| WO | WO 00/21053 | 4/2000 |
| WO | WO 03/025774 A1 | 3/2003 |
| WO | WO 03/075216 A1 | 9/2003 |
| WO | WO 2004/021601 A1 | 3/2004 |

OTHER PUBLICATIONS

French Search Report dated Feb. 16, 2005.

* cited by examiner

500

| 502 TAG - ID | 504 LMD - ID | 506 TIME STAMP | 508 OTHER |
|---|---|---|---|
| TAGx 510 | LMD 1 518 | TIME 1 520 | |
| | LMD 2 522 | TIME 2 524 | |
| | LMD 3 526 | TIME 3 528 | PANIC 560 |
| TAGy 512 | LMD 3 526 | TIME 1 520 | |
| | LMD 2 522 | TIME 1 520 | TAG 570 BAT LOW |
| | LMD 3 526 | TIME 3 528 | 580 TAMPER |
| TAGz 514 | LMD4 530 | TIME 1 520 | |
| | LMD 4 530 | TIME 2 524 | 590 NO LINE |
| | LMD 4 530 | TIME 3 528 | |
| TAGz+1 516 | : | : | |
| | : | : | |
| | : | : | |

FIG. 5

MONITORING AND TRACKING NETWORK

BACKGROUND OF THE INVENTION

1. Field of the Invention

The present invention relates to a system and method for tracking of individuals in general and in particular to a network system and method for tracking and monitoring persons by using a communication line as well as radio frequency transmitters and receivers, working in conjunction with a central monitoring system which is capable of collecting and summarizing the activity of the system.

2. Discussion of the Related Art

Persons tracking and monitoring systems use wireless and GPS (Geographical Positioning System) technology for tracking persons such as offenders, mentally incapacitated or inapt persons. Such tracking of persons may be required medically or legally by the court system.

One persons monitoring system involves the use of a limb worn short range radio frequency (RF) transmitting device (tag), a body worn GPS localization and wireless transmission device, also known as Localization and Transmission Device, (LTD) and a central monitoring station (CMS) for receiving wireless information from body worn devices. The tag communicates with the LTD for the purpose of assurance that the LTD is in close proximity with the monitored person. The tag typically has an anti-tamper mechanism. When a monitored person is tampering with the transmission or the tag device or attempts to remove the tag from the limb, a wireless communication message is transmitted to the central monitoring station (CMS). Some similar applications also include a panic button. The panic button sends a wireless communication message routed to the central monitoring station. The body worn LTD is functional in geographical localization of said device and for the transmission of the location to a central monitoring station (CMS) via wireless communication. The geographical localization in such a system is realized via GPS technology. Through the operation of a GPS receiver located within the LTD, the geographical location of the LTD and a time stamp are temporarily stored in a memory device within the LTD and then transmitted via wireless communication to the CMS. The wireless transmission is thus routed through a local wireless network. Some systems have the capability to connect to a stationary device for transmission of location and time stamp information via landline. This feature is performed only when the monitored person is at home or at a base station where such a device is located. The CMS is typically a computer connected to the wireless network. The CMS receives the transmissions sent from the different LTD's, processes and displays the transmissions to the monitoring personnel. The processing involves summarizing the location and time stamps of each LTD monitored by the system as well as the status of the LTD and tag, such as battery level, anti-tamper mechanism condition, etc. The computer of the CMS also plots the location of the LTD's given by the GPS coordinates received from overhead satellites as a function of time stamp also received from said satellites on an electronic map generated by the computer. In some peoples tracking systems, the personnel monitoring the system can set rules and regulations for each monitored person. Such rules are referred to in the art as location and time constrictions rules. Location and time constriction rules are sent via wireless network to the appropriate LTD where they are stored in the LTD's memory. The LTDs constantly compare the location and time stamp obtained from the GPS with the rules stored in their memory device. These rules are intended for example, for the prevention of a monitored person from being present in a certain location at a specific time frame. For example, a person may be barred from entering a two-mile radius or zone from the house of a victim. In a characteristic operation of such a system, if a person violates the rules set up by the system, a wireless message is sent to the CMS. Personnel monitoring the system in the CMS can then alert law enforcing agents in order to intercept the person, as well as send a warning message to the LTD located on the person.

The present offered systems of the kind described above have several drawbacks. For an estimate of the LTD location and time stamp using GPS technology, at least four orbiting satellites are required. In locale and during time periods where satellite cover is inadequate, the systems ability to track the monitored persons is diminished or non-existent. In addition, the use of a GPS receiver is power demanding and requires the use of high-energy battery.

The above-mentioned persons tracking system uses wireless communication for the transmission of information between the LTD's and the CMS. However, wireless communication may be hampered by crowded wireless systems. Tracking and monitoring systems of the GPS/wireless type are intended for use mainly in urban areas that are already heavily crowded with cellular communications. In addition, the loss of wireless connection in conditions of reduced reception can also hamper the systems operation. This is important especially around sensitive locale such as in and around victim's houses, banks, work places and the like, where the wireless network often has diminutive reception. There is therefore a need in the art for a persons tracking and monitoring system that is independent of GPS technology or wireless communication such that the lack of satellite coverage and wireless communication coverage will not impede tracking and monitoring. There is a need for a system that can track and monitor a person around specific locations at specific times and at the same time uses relatively cheap and low weight carried equipment by the monitored person.

An RF only based monitoring system involves the use of local radio frequency (RF) signals for the localization of individuals who are monitored. In such a system the monitored person is wearing a one way RF transmitting tag. This tag is transmitting periodically and could also be fitted with some anti-tamper and panic mechanisms. The RF signals emanating from the tag are received by a local monitoring (receiving) device typically situated in an area where the person spends most of his time such as in the person's house. The local monitoring device is tuned to identify only to the specific tag worn by the person. When the person wearing the tag is located within the reception range of the local monitoring device, the tags identification code and a time stamp is sent to a central monitoring system via telephone for processing and display. A drawback of this system includes the small coverage area of the system as a whole and the rigid association of local monitoring device to a specific tag. The monitoring system mentioned above is limited by the limited reception range of the single local monitoring device tuned to one tag. People wearing a tag can only be monitored when in range of the specific monitoring device, typically around their house. Thus when a person wearing a tag is away for shopping, visiting friends etc. he is not monitored and his whereabouts are unknown.

There is therefore a need for a monitoring system that is able to monitor any person wearing an RF transmitting tag over various locations in a cost effective manner. There is a need for a monitoring system using a light weight tag which is capable of placing monitored persons to specific locations while using small and relatively cheap system components for the intended task.

SUMMARY OF THE PRESENT INVENTION

It is an object of the present invention to provide a novel method and system that enhance and add to the capabilities of people tracking and monitoring systems, which overcomes the disadvantages of the prior art.

In accordance with one aspect of the present invention, there is thus provided a system for wide area monitoring and tracking of individuals and other objects. The system comprises a computerized central monitoring server comprising a processor for processing data, a memory device for storing data and a display device for displaying data; a plurality of transmitting tags, which may be one or two way transmitters, attachable to monitored individuals. Each of the transmitters having a unique identification code and includes a transmitter, which periodically broadcasts a signal carrying a first data regarding the individual to whom the tag is attached. The first data includes the tag's identification code. A plurality of local monitoring devices distributed at predetermined locations, each of the plurality of local monitoring devices comprises a receiver receptive to signals transmitted from any of the plurality of tags when a tag is within reception range of a local monitoring device. The system also includes a data processor for processing the first data carried by said signals, a memory device, and a communication device for communicating according to predefined schedule a second data to the central monitoring server. The second data includes whole or part of the first data and additional data concerning identity and status of the local monitoring device communicating the second data. The transmitting tags may further include a receiver for allowing communication with each other. The predetermined locations include locations associated with each of the plurality of monitored individuals and wherein a local monitoring device located at a location associated with a specific monitored individual, the local monitoring device includes within its memory device a set of rules regarding presence and absence of said specific monitored individual within the reception range of the local monitoring device. Upon violation of said rules by said specific monitored individual, a message is sent to the central monitoring server. The predetermined locations may further include locations external to the monitored person's home. The predetermined locations may further include vehicles or places of business. The locations associated with the monitored individuals include residence and/or work locations of the monitored individuals. The predetermined locations further include public locations not associated with a particular monitored individual. The transmitter could be a single or multiple channel RF transmitter or transceiver. The local monitoring devices can be mobile or stationary. The local monitoring device may be installed in a vehicle. The central monitoring server processes the data communicated from the plurality of local monitoring devices to obtain information regarding the plurality of monitored individuals and further manipulates the information for tracking monitored individuals by crossing information concerning a particular monitored individual received from different local monitoring devices. The obtained information may be displayed graphically in a map. Alternatively no display is required for this information and the system central monitoring station may operate without the use of a monitor and without the use of a display. The transmitting tags further include anti-tamper mechanism for indicating attempts to remove and/or to damage the tag and wherein the first data carried by the transmitted signals include data concerning tamper attempts. The local monitoring devices further include tamper evidence mechanism indicating attempts to remove or to damage the local monitoring device and wherein upon such an attempt a message is sent to the central monitoring server. The communication means for communication between a local monitoring device and the central monitoring server comprises a telephone line or a cellular telephone network or a data network or a telecommunication signal network. The telephone line can be a dedicated line. The communication means for communication between a local monitoring device and the central monitoring server comprises a local or wide area network. The local monitoring device further includes a transmitter capable of broadcasting signals receptive by other local monitoring devices having overlapping reception/transmission range with the local monitoring device. Upon failure of the communication means between a local monitoring device and the central monitoring server, the local monitoring device broadcasts the second data via the transmitter to be relayed to the central monitoring server by other local monitoring devices.

In accordance with a second aspect of the present invention there is provided a wide area monitoring and tracking method for monitoring and tracking a plurality of individuals. The method comprises the steps of providing each of the plurality of individuals to be monitored with an attachable tag, each of the plurality of tags periodically broadcasting a signal carrying a first data regarding the individual to whom the tag is attached, the first data includes the tag's identification code; distributing a plurality of local monitoring devices at predetermined locations, each of the plurality of the local monitoring devices receiving signals transmitted from any of the plurality of tags when a tag is within reception range of a local monitoring device; processing at the local monitoring device the first data carried by said signals; communicating from the local monitoring devices according to predefined schedule a second data to the central monitoring server, the second data includes whole or part of the first data and additional data concerning identity and status of the local monitoring device communicating the second data. The predetermined locations include locations associated with each of the plurality of monitored individuals and wherein a local monitoring device located at a location associated with a specific monitored individual includes within its memory device a set of rules regarding presence and absence of said specific monitored individual within the reception range of the local monitoring device.

BRIEF DESCRIPTION OF THE DRAWINGS

The present invention will be understood and appreciated more fully from the following detailed description taken in conjunction with the drawings in which:

FIG. 5 is a schematic illustration of data displayed at the central monitoring system of the present invention in a tabulated form.

DETAILED DESCRIPTION OF THE PREFERRED EMBODIMENT

The present invention overcomes the disadvantages of the prior art by providing a novel method and system that enhance and add to the capabilities of people tracking and monitoring systems.

The general scheme of the persons tracking and monitoring system of the present invention comprise three major elements: at least one Radio Frequency (RF) or similar signal transmitting tag worn by a monitored person, a multitude of Local Monitoring Devices (LMDs) each capable of receiving RF signals from a multitude of transmitting tags and converting the RF signals into data to be communicated to a Central Monitoring Server (CMS) capable of transmitting and receiving data to, and from said multitude of local monitoring devices via telephone or via other communication paths. The Central Monitoring Server processes and displays the data in such a manner that the location and whereabouts of any person wearing a tag can be ascertained to designated areas covered by local monitoring device network. While the present invention uses as an example the carriage of data from the LMDs to the CMS by means of a landline, other means of communication are also contemplated. Such can include any communication paths including as non-limiting examples cellular communication, satellite link up, Wide and Local Area Networks and the like.

Figure 1:
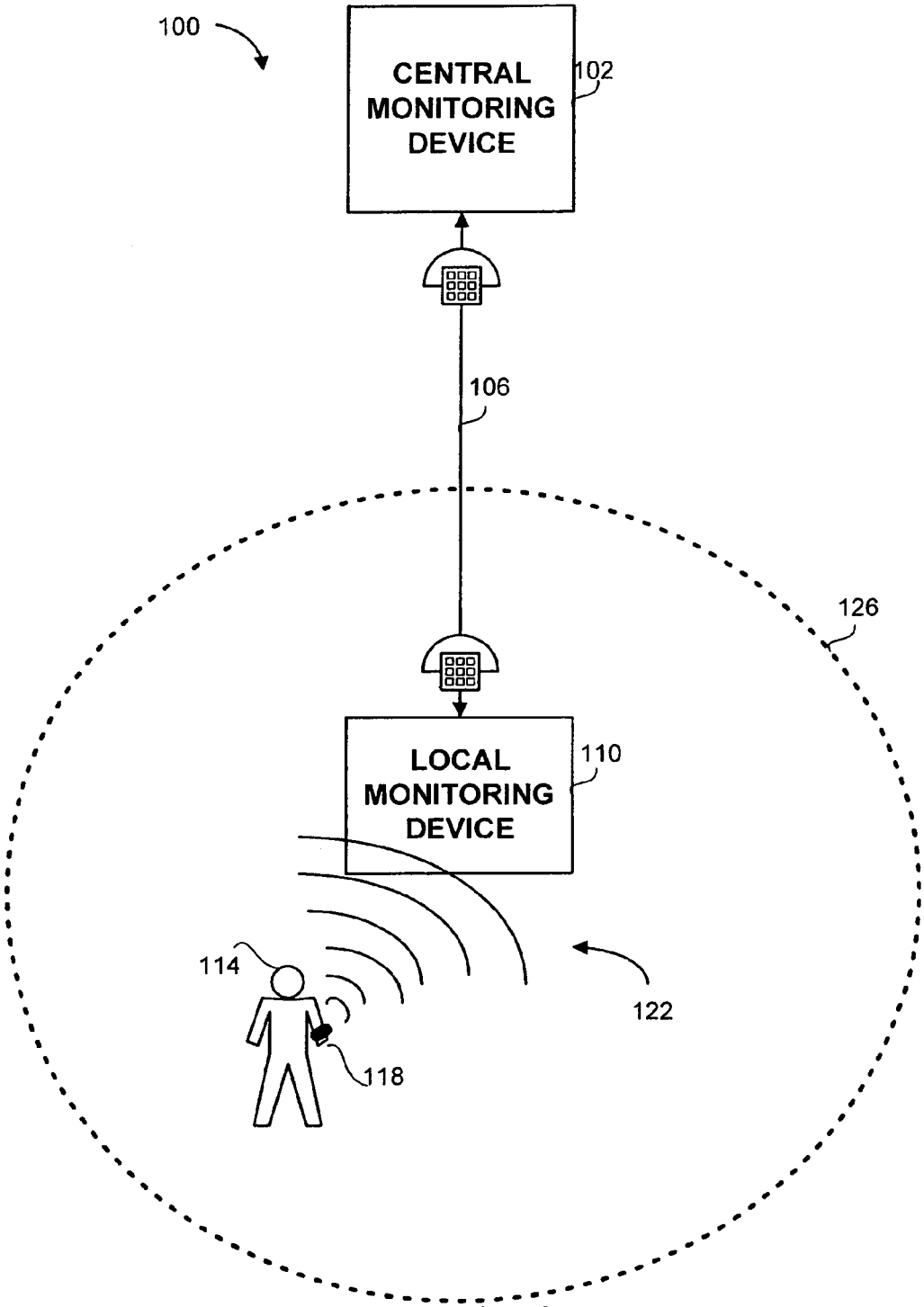
FIG. 1 PRIOR ART
FIG. 1 is a schematic illustration of a people tracking and monitoring system known in the art.

Reference is now made to FIG. 1, which is a schematic illustration of a prior art monitoring system, generally referenced 100. System 100 is typically used for home monitoring of persons such as offenders, mentally deficient persons etc. The system can also be used to monitor or track any other person or group of persons. System 100 includes a Central Monitoring Device (CMD) 102 (also known as Central Monitoring Server (CMS), a telephony data landline 106, a Local Monitoring Device (LMD) 110, and a transmitting tag (tag) 118 attached to monitored person 114. Tag 118 is typically a limb worn device, worn either on a leg or the hand of the monitored person 114. Tag 118 is fashioned to fit the limb and is typically provided with anti-tamper mechanism (not shown). The anti-tamper mechanism of tag 118 can comprise a strap cut anti tamper mechanism and a mechanism to detect the presence of a body within the strap circumference. Tampering with the tag, such as trying to cut or remove the tag will trigger a tamper alert. Tag 118 includes a one way RF transmitter periodically transmitting RF signal 122 which carries a tag unique identification code as well as other information relating to the tag's components status.

Local Monitoring Device (LMD) 110 is a hardware device typically located in the person's home. Device 110 may be connected to its location via fastening means such that it cannot be removed (not shown), and like tag 118 has anti-tamper mechanisms. Alternatively LMD 110 may have a motion sensor (not shown) which will alert the CMD 102 if an attempt to move the LMD 110 is made. In such case the LMD 110 may be moveable. Device 110 is capable of detecting RF signal transmissions originating within the LMD 110 reception range 126. The LMD 110 can receive, identify and process RF signals from only one dedicated tag 118. Device 110 then processes the RF message for content and examines the ID code carried by the signal received. If the signal ID code corresponds to the ID code stored on device 110 memory, processor of device 110 adds a time stamp to the ID code originating form tag 118 RF signal and stores it temporarily on a memory device (not shown). LMD 110 may also include a sensor for determining whether the LMD device itself itself istampered. Using a modem device (not shown) LMD 110 establishes a telephony data connection with the CMD 102 and per predefined schedule sends data stored on the memory card via telephony line 106.

In an alternative embodiment of the present invention, LMD 110 may be located in various locations, private and public. For example, the LMD 110 may be located in public places where it can receive and monitor multiple subjects. The LMD 110 may be located in a train station, a bank, a store or adjacent to roads and highways. The LMD 110 may also become a mobile unit which can be placed on a vehicle or carried by a person. Such LMD 110 would have cellular communication means or other means to communicate with a central monitoring station. Such LMD would also have location identification capabilities. In one example, such mobile LMD may have a GPS device connected thereto. In another embodiment the LMD may be connected to the vehicle's odometer and wheel thus extrapolating the vehicles location at any given time given the initial vehicle location. Such mobile LMD may be battery operated or connected to the power sources of the vehicle it is installed therein. The LMD may operate independently of the vehicle operator. Thus numerous LMDs may be located in numerous vehicles providing an effective LMD coverage for areas having significant traffic of vehicles. The ability to position LMD 110 as noted above (both outside the offender's house and as a mobile or vehicle carried device) enables the creation of an LMD network. The LMD network is later described in detail in association with FIG. 6. Locating LMDs in this manner also enables a central monitoring system to determine the location of an offender with greater accuracy through receiving multiple signals from the various LMDs and extrapolating the location of an offender and whether such an offender is compliant with rules provided to him.

In the monitoring system designated 100, the CMD 102 is characteristically, a computer device connected via telephony line 106 to LMDs 110. CMD 102 is typically programmed to receive information from any number of LMD devices 110, each tuned to a specific tag 118 which sends Information regarding the presence or absence of the tag, as well as other hardware related data such as tamper and battery status and like other status information relating to the specific tag. Characteristically, the LMD's are located in the person's residence or in sites where monitoring this person is required. CMD 102 receives, processes the information from each LMD and displays such information to monitoring personnel. The information gathered within CMD 102 can be used to inform on the presence or absence of the monitored person from the designated monitored area. In the example illustrated in FIG. 1 the monitored person 114 wearing tag 118 can be found in a designated area 126. CMD 102 is unable to follow person 118 when not present within the reception range of LMD 110. This singularity of LMD and tag applies to persons monitored by prior art home monitoring system. CMD 102 can upload rules and constriction data to LMD 110 via telephony line 106. Such data may include times of confinement to the reception range and the like. As in similar monitoring systems, when a person is inconsistent with the rules and regulations set up by the system, CMD 102 may be programmed to contact law-enforcing agents (not shown) for the interception of the monitored person 114.

Figure 2:
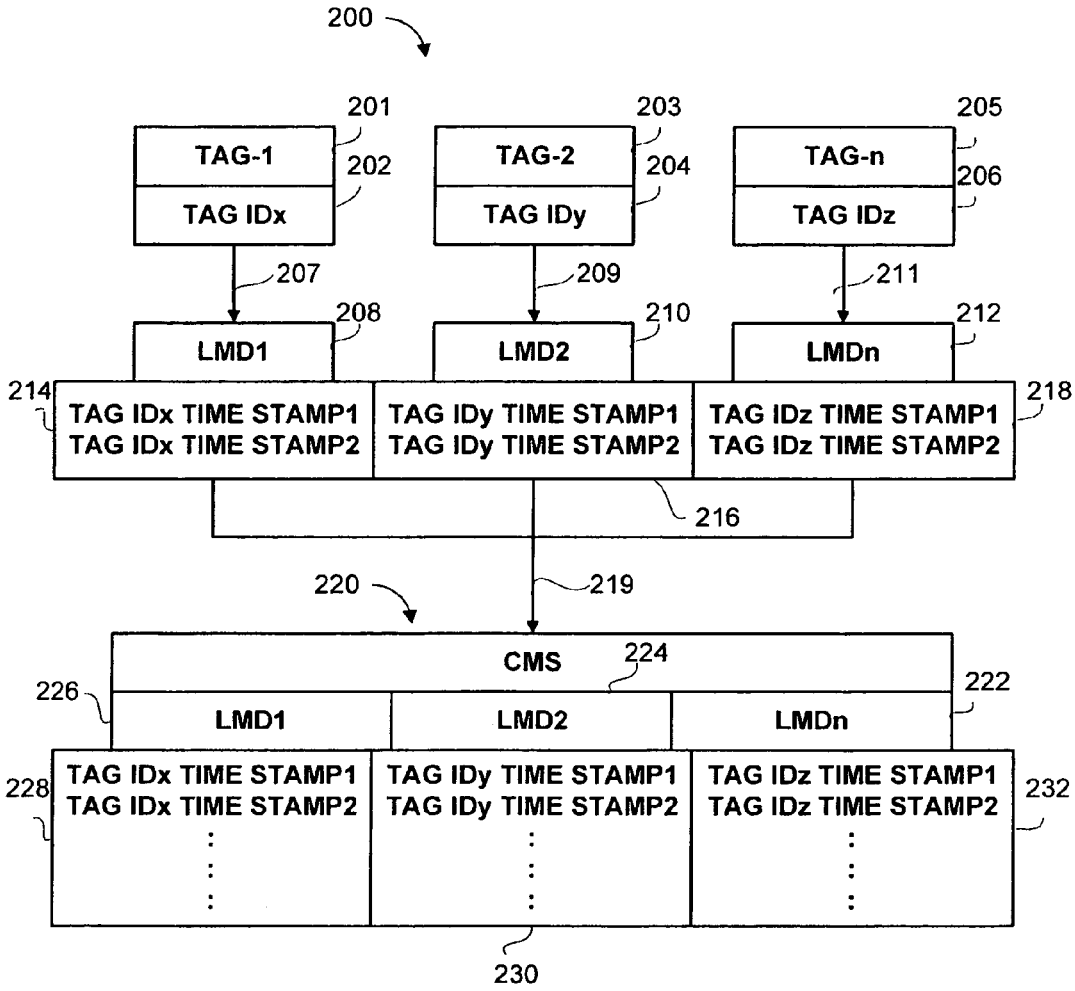
FIG. 2 PRIOR ART
FIG. 2 is a flow chart diagram representing data flow in the prior art people tracking and monitoring system illustrated in FIG. 1.

Reference is now made to FIG. 2, which is a flow chart diagram representing a partial but crucial data flow in connection with the monitoring system illustrated in FIG. 1. The persons tracking and monitoring system illustrated in FIG. 1 depicts one transmission tag device, one local monitoring device and one central monitoring system (118, 110, 102 respectively of FIG. 1). Presently, the system may provide for monitoring a plurality of persons wherein each monitored person is fitted with a transmission tag (tag) having a unique ID and a local monitoring device (LMD) dedicated to said tag, i.e., each LMD is responsive only to its corresponding tag. Each tag 201,203 and 205 of FIG. 2 in the monitoring system has a tag identification (ID) code that is unique. For example, Tag-1 201 has TAG IDx 202 ID code, tag-2 203 has TAG IDy 204 ID code and so forth such that tag-n 205 has TAG IDz 206 ID code. Each of tags 201,203 and 205 emits RF signal containing a message that includes the tag ID code as well as other parameters relating to the tag status such as anti-tamper status, battery level (not shown). When tags 201, 203 and 205 are within reception range of Local Monitoring Devices (LMD's) 208, 210 and 212, LMD's receive tags 201, 203 and 205 transmission as seen is steps 207, 209 and 211 respectively. In steps 214, 216 and 218, each LMD 208, 210 and 218 adds a time stamp and temporarily stores them in a memory device (not shown), such that within the memory device of LMD1 208 an information set seen in step 214 is built. This information set contains the tag ID and status information (not illustrated) and relevant time stamp. For example, information set seen in step 214 within memory device (not shown) of LMD1 contains tag IDx plus other relevant information plus time stamp1, tag IDx plus other relevant information plus time stamp2 and so forth. The same applies to LMD2 210 and LMDn 212 and their respective information sets seen at steps 216 and 218 respectively.

In step 219 LMD's 208, 210 and 212 connect via a modem (not shown) and a landline (not shown) to the CMS 220 and transfer the information sets data created at steps 214, 216 and 218 to the CMS device 220. Step 219 takes place on a predefined schedule or by predefined rules. In CMS 220, the data is processed per LMD as illustrated by steps 228, 230 and 232 and saved in a storage place (not shown). This means that for every LMD sending information to the system there exists a file holding tags ID, other information and time stamping. For example, in CMS 220 illustrated in FIG. 2 data file of LMD1 226 contains data processed in step 228 such as TAG IDx plus other relevant information (not illustrated) and time stamp 1, Tag IDx plus other relevant information (not illustrated) and time stamp2 and so on. The data file created at steps 203 and 232 for LMD2 224 and for LMDn 222 follows the same pattern as for LMD1 226 described here and above. The system can monitor the presence or absence of person wearing a tag within a very small geographical area and when not present there within, no data pertaining the person location is known.

Figure 3:
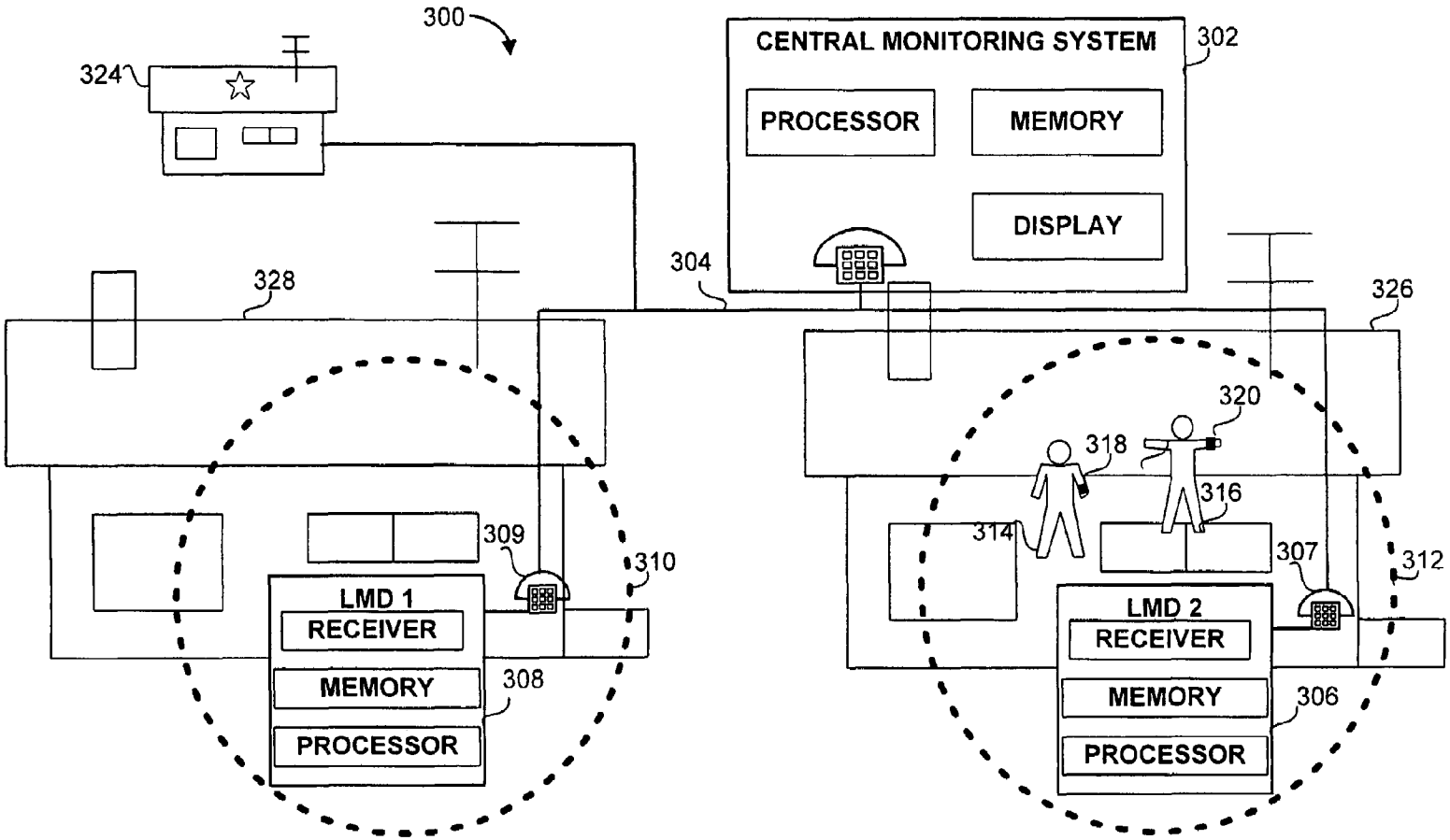
FIG. 3 is a schematic illustration of an exemplary embodiment of the present invention illustrating the relationship of the monitored people, the local monitoring devices and the central monitoring device.
Figure 3A:
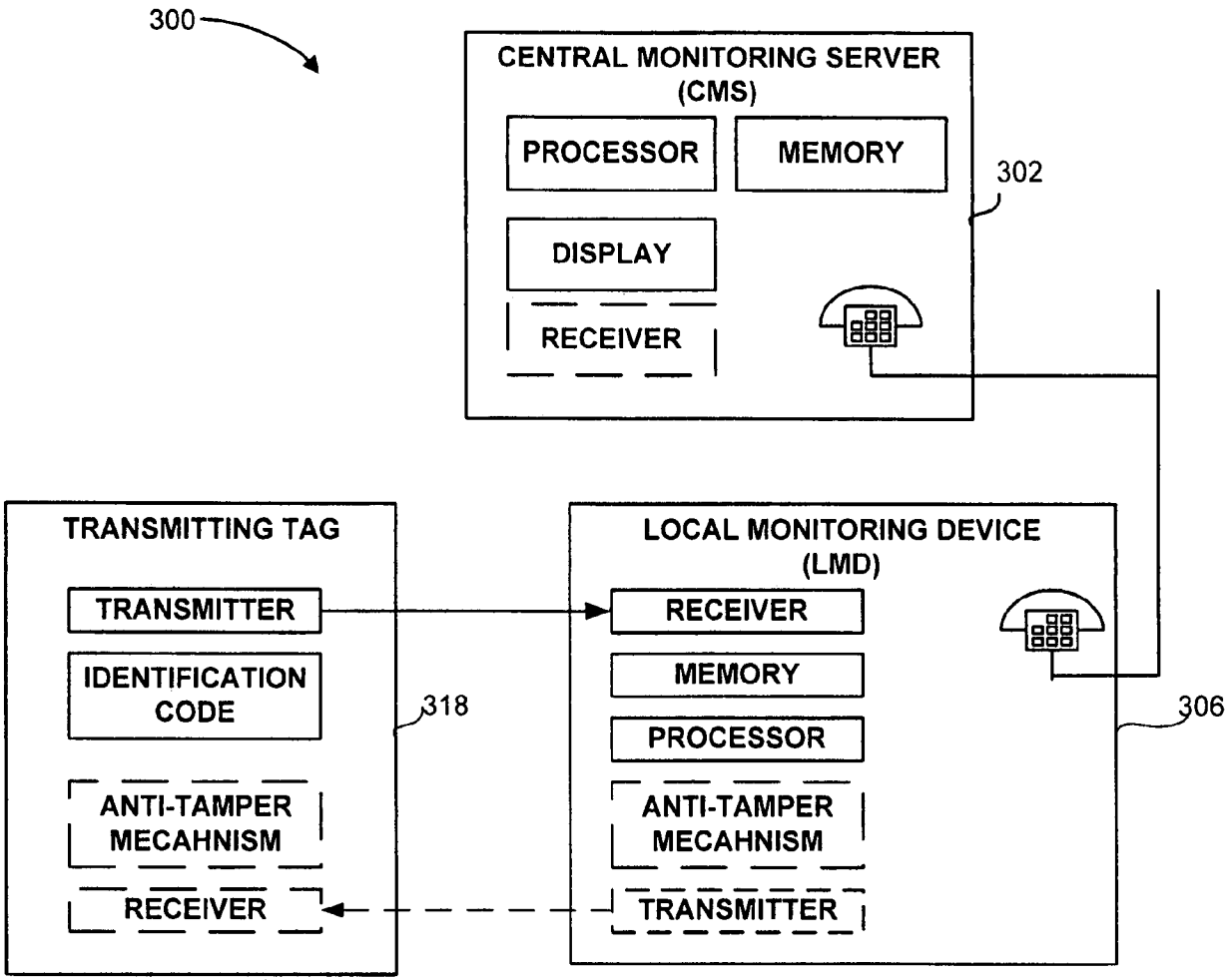

Reference to FIG. 3 is now made where a schematic illustration of a persons tracking and monitoring system according to the preferred embodiment of the present invention is illustrated. The tracking system is referenced 300. FIG. 3A illustrates system 300 in a block diagram manner, showing internal elements of the central monitoring system (302), an exemplary local monitoring device (30) and an exemplary transmitting tag (318) where optional elements are shown in dashed lines. Although the persons tracking and monitoring system described hereforth is intended for tracking and monitoring offenders, it will be apparent to the person skilled in the art that this system can be used to track and monitor other persons such as mentally inapt persons such as in the case of Alzheimer's disease, persons suffering from other Neuro-degenerative diseases, mentally retarded individuals, children of early age as well as animals such as domestic animals like cats and dogs. In the description that follows, the people tracking and monitoring system 300 is intended for tracking the movement and whereabouts of an individual. It can be easily understood that this system can also be used to confine a monitored person to a particular locale or to exclude him from certain areas.

System 300 described below uses the same general setup of the home monitoring system 100 but adds to and improves the system such that tracking of persons wearing an RF transmitting tag is possible on a very large geographical area. Persons tracking system 300 comprises a Central Monitoring System (CMS) 302 connected via telephony data landline 304 and/or other mean of long range communication to Local Monitoring Devices (LMD) 306 and 308 and through such communication means is capable of monitoring the whereabouts of RF transmission tags (tag) 318 and 320. Tags 318 and 320 are battery powered, anti-tamper, one way, short or long-range, RF transmitting devices capable of transmitting a unique identification (ID) code on a wave carrier signal as well as a multitude of other tag related information. Tags 318 and 320 are specially designed non-removable limb or hand (wrist) worn transmitters worn by persons 314 and 316 respectively. Tags 318 and 320 comprise a limb or hand (wrist) shaped box having an RF transmitter, a processor, a memory device, a battery, an anti-tamper device as well as sensors such as motion, ambient temperature, acceleration, tilt, and pulse detection for the purpose of tracking and monitoring both the location and physical condition of persons 314 and 316. Persons skilled in the art will appreciate that other sensors may be added to Tags 318, 320. Person 314 and 316 typically wear tags 318 and 320 at all times. Tags 318 and 320 can additionally be used to restrict persons movement such as for example, to restrict persons movement to certain designated locale during certain times such as home or work place, to restrict their presence from other locales at all times such as victims house, schoolyards, playgrounds, bars or potential crime scene. Tags 318 and 320 are fitted with anti-tamper mechanism and optionally with a panic button, such that if persons 314 or 316 try to manipulate or remove the tags or if they push the panic button, a coded RF transmission is transmitted until reset is performed. Reset can also be performed by special hand held reset device carried by law enforcement personnel (both not shown). Another feature of tags 318 and 320 is the "sleep" mode where the tag stops transmitting RF signal in order to save battery power. Such "Saving Power" mode is automatically activated according to the type of person and the tag.

In the preferred embodiment illustrated in FIG. 3 Local Monitoring Device 1 (LMD1) 308 is situated in residence 328 where person 314 resides while LMD2 306 is situated in residence 326 where person 316 resides. Although FIG. 3 describes only two LMD's, additional LMD's can be located in a victim's house, work place of person or victim, a bank, a store as well as any other site where detection of monitored person is preferred. LMD1 308 and LMD2 306 are electrically powered, anti-tamper, tilt safe, single channel RF receiver/transmitters capable of receiving, processing and sending any tag RF signals within reception range and channel frequency range. Processing and sending by said LMD's involve adding time stamp, further processing the information, saving information and sending the data via communications line at predefined schedule. LMD1 308 and LMD2 306 include an RF receiver/transmitter, a processor device, a memory device, an inner clock (which may be part of the processor device), a modem device, an anti-tamper device, optionally, a tilt sensor, a power device such as a rechargeable battery, and optionally, phone/data connections as well as an electrical inlet/outlet connection. In addition, the LMD may optionally include an Infra Red (IR) transceiver, a cellular transceiver, a backup power source such as a backup battery pack to insure continuous work in case the main power source fails or is depleted. The LMD may be water proof if installed outside the home where it is subject to the weather elements. If installed outside a building the LMD may also include UV protection covering to avoid malfunctions due to ultra violet sun light and high temperature exposure. In addition and optionally, the LMD may include a heating or cooling device to heat or cool the LMD if exposed to extreme temperatures (such as below 30 F). LMD1 308 and LMD2 306 are fastened to their designated physical location and fitted with anti-tamper mechanism such as cover and movement sensors in such way that if anyone attempts to tamper with or removed them, a specialized code is sent to CMS 302 alerting monitoring personnel of the attempts. LMD'S 308 and 306 processes, save and send information received from any tag momentarily or permanently located within reception range of LMD receivers. Said LMDs operate according to predefined rules and regulations preset by the manufacturer, updated on installation as well as updated in real time during operation via uploading of information from CMS 302. A telephone line is typically used for messages transmission and data exchange between LMD's 308,306 and CMS 302. The telephone line availability (via dial tone) and functionality (via electric current status) is constantly evaluated by the LMD's. Any tamper attempt with the line evokes a coded message sent to the CMS 302. LMD's 306 and 308 are capable of transmitting RF signals via RF transmitter device therewithin as further discussed in conjunction with FIG. 4.

Figure 4:
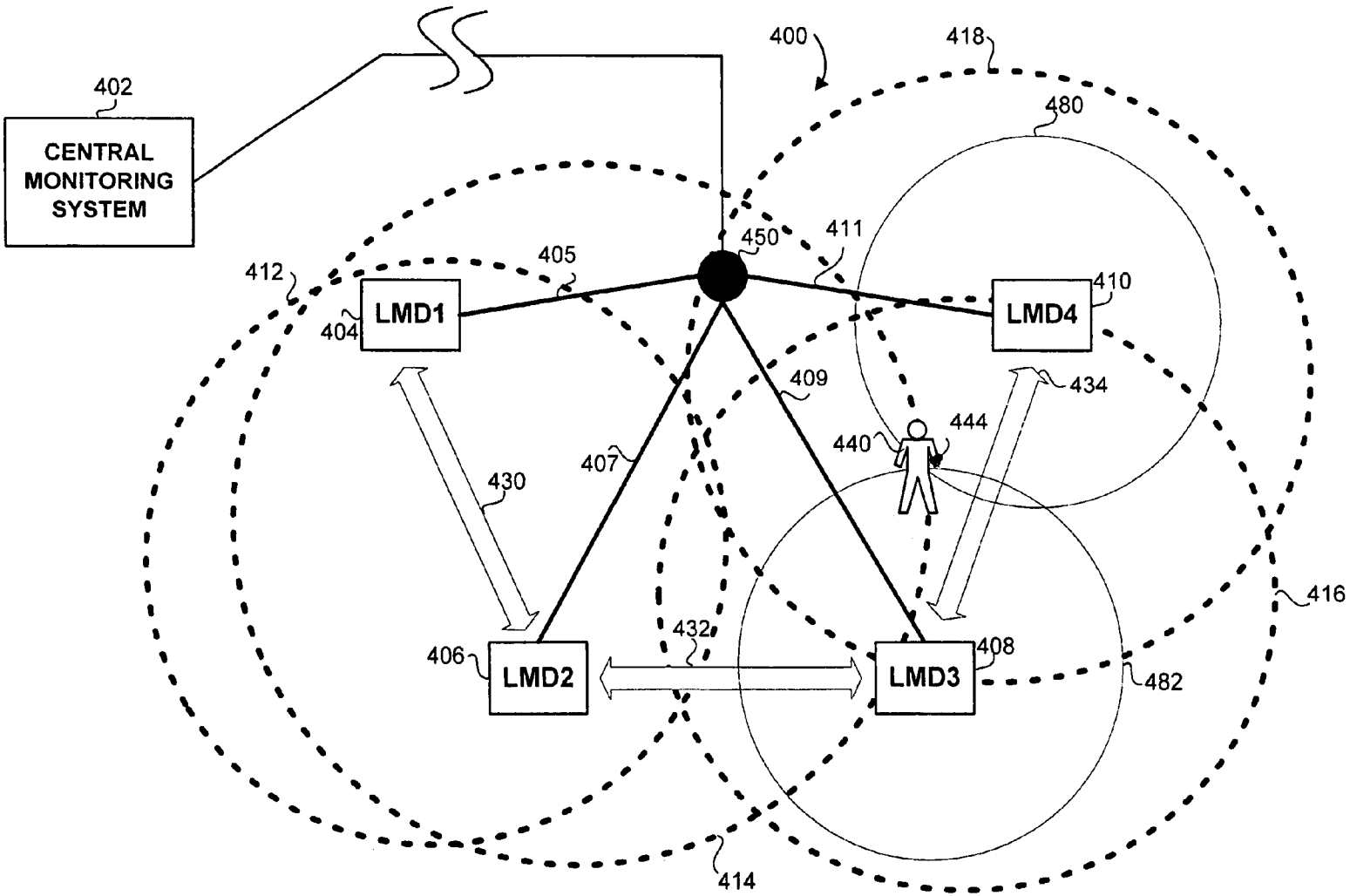
FIG. 4 is a schematic illustration of alternative data transmission modes as well as person's geographical localization capability of the preferred embodiment of the present invention.

Central Monitoring Server (CMS) 302 is a computer device or a network of computers connected via telephony landline or other means for communicating data (for example: LAN or WAN, long range RF and the like) to LMD 306 and 308 as well as to law enforcing facility 324. CMS 302 can additionally be connected to other relevant establishments such as welfare institutions, health care facilities, fire department brigade etc. CMS 302 receives data from LMD's 306 and 308. The data includes ID code of tags 318 and 320 with respective time stamps as well as other tag related information. LMD1 308 and LMD2 306 also send data concerning LMD status such as tamper status, telephone line status, battery and the like. Data is transferred to CMS 302 and where applicable (or required) from CMS 302 to LMD's 306 and 308 according to predefined schedule and predefined event rules. For example, predefined schedule can involve an hourly report as well as a daily report. Any other transmission time frame can be used. Event rule are predefined events prompting data transmission and can include among others certain ID tag presence with a certain LMD reception range, particular ID tag absence from a certain LMD reception range, any tag presence with a certain LMD reception range etc. Data is transmitted to CMS 302 via telephone. Alternatively data can be transmitted via RF transmissions or a combination thereof. Another option can include the optional use of a cellular network, satellite network and other modes of data transmission. In CMS 302 data is processed, stored and displayed to monitoring personnel. CMS 302 data manipulation can include generating sets of data according to specific tags, LMD's, locale, time frame as well as other data manipulation suited for the purpose of person tracking and monitoring. Further processing can include comparing received data against a set of predefined rules and regulation that apply to each particular tag 318 and 320. The rules can be redefined and altered by monitoring personnel. If location and/or time data received from LMD1 308 and/or LMD2 306 conflict with set rules and regulations, monitoring personnel are alerted by the system. Optionally, law enforcement or medical establishment or like establishment or business 324 is alerted as well via landline 304 as well as via other communication methods known in the art. Data received by CMS 302 is saved in a memory device (not shown) such that data previously received can be compared to data received in real time as well as evaluated, analyzed and displayed to the monitoring personnel of CMS 302. Display of data is done in user-friendly format such as via tabulation, graphical representation as well as map plotting. Data can be further manipulated such as with printing via a printer device, sent via computer network, as well as other modes of communications. The communication line 304 connecting CMS 302 to LMD 306 and 308 and other authorities such as law enforcement authority 324 is periodically checked. Such checks are performed, for example, by examining line electrical potential. In a cellular network or satellite network, the modem's registration to the network is checked to determine if a connection is established. If any LMD is not reached (busy line) the CMS tries again. If line is still unavailable routing information via other LMD's as illustrated in FIG. 4 is attempted. Other modes of communication when applicable can also be attempted. If no connection is established the law enforcement or other establishment 324 is informed so that appropriate action can be executed.

In accordance with the present invention, and contrary to previous systems, the people tracking and monitoring system 300 tracks and monitors any tags irrespective of the local monitoring device that detects the tag. Each tag can be detected and registered by any LMD connected to the CMS thus enabling a cost effective and distributed system for people tracking. Such system is capable of covering large areas, greater than a single cell in a cellular network. In addition the present system is cheaper to manufacture and to use than dedicated GPS systems. Tracking and monitoring by system 300 can alternatively be performed according to LMD's, geographical areas and the like. FIG. 3 depicts two persons 314 and 316. Individuals 314, 316 can be any persons (like offenders or patients or animals) being tracked or monitored. Person 314, wearing tag 318, resides at residence 328 where LMD1 308, having reception range 310, is situated. Person 316, wearing tag 320, resides in residence 326 where LMD2 306 is situated. In FIG. 3, both persons 314 and 316 are located at residence 326 where LMD2 306 is situated. This situation can correspond to person 314 visiting person 316, person 314 passing in a close proximity to LMD2 306 reception range 312 etc. At this instance LMD1 308 is not receiving any tag transmission and this information is registered and saved in memory device therewithin (not shown). This information could consist of a rule violation such as when person 314 should be within reception range at this time. If so, an event is actuated and an immediate connection and data transfer to CMS 302 occurs. Tags 318 and 320 worn by persons 314 and 316 respectively are in reception range of LMD2 306 alone. Such person may, in the present non-limiting example, be away from the home or facility and an LMD remote to the LMD located at the home or facility receives the tag's transmission. At this time LMD2 306 receives and register both tags such that CMS 302 will be informed either immediately or after delay on the whereabouts of both tags 318 and 320. If person 314 is forbidden from entering reception range of LMD2 306 such as by a rule definition currently in LMD2 306 memory device (not shown), or is sought out by the system such that entry into the reception range of any LMD is a rule violation, person 314 tag 318 presence will promote an event that will be reported immediately to CMS 302 such that appropriate action can be taken. Such action may include a message to law enforcement agency 324 as well as other actions. It will be appreciated by those skilled in the art that in areas having more LMDs the level of resolution identifying persons wearing tags is increased. So, for example, if LMDs are located in the homes of the monitored persons and in the various establishments wherein persons ordinarily visit, such as banks, stores and the like, the system of the present intention will allow specific monitoring and tracking of persons within a large area.

Turning now to FIG. 4, which is a schematic illustration representing alternative data transmission modes as well as person's geographical localization capability of the preferred embodiment of the present invention. The persons tracking and monitoring system 400 described here and above use radio frequency for the detection of tag presence or absence within reception range of any local monitoring device. Information transfer between the central monitoring station and any local monitoring device is preferably performed via telephone landline. It may however be accomplished via wireless means such as a wireless network or a satellite network and the like. Information may also be transferred between the tag and a receiver and between tags. In the following description alternative novel modes of communication and data transfer between the central monitoring system and the local monitoring devices as well as between the local monitoring devices themselves are described. In addition another innovative feature of the system is described, that is the ability of the system at certain locations to accurately geographically localize a person wearing an RF transmitting tag. It will be evident to the person skilled in the art that the reception ranges described in previous figures demonstrating the ability of an LMD to receive a transmission from any tag found within their reception range is for illustration sake only. It should be clear to the person skilled in the art that for an LMD to receive the signals transmitting from a transmitting tag, the transmission range of the transmitting tag and the reception ranges of the LMD must overlap. The same apply to the possibility of transmission from one LMD to another. A transmitter has "a range" under known conditions. The signal travels to a distance based on the power of transmission and efficiency of antenna. The receiver is qualified by "sensitivity"—a "sensitive" receiver can receive weak signals, where less sensitive receiver can only receive stronger signals. Therefore the absolute "range" for transmitter—receiver communication is determined by the transmitter. A better (more sensitive) receiver would for any given transmitter be able to identify transmission from a longer distance than a less sensitive receiver. In the present invention a tag may be considered as a receiver when it receives a transmission from another tag and acts as a receiver for the purpose of receiving said transmission. Thus, tags may communicate with each other thus extending the range of the system described in the present invention.

The people tracking and monitoring system 400 described in FIG. 4 comprises a Central Monitoring Server (CMS) 402, four Local Monitoring Devices (LMD) 1 through 4 designated 404, 406, 408, and 410 respectively having a receiver and a transmitter such that LMD's can receive and transmit RF signals. LMDs 1 through 4 have overlapping respective RF reception ranges designated 412, 414, 416 and 418 respectively. These RF reception ranges described here refer to reception ranges of other LMDs transmission. The tag may also include a receiver through which tag parameters may be changed through a communication message provided by the LMD to the tag. The LMD may also be connected to a power source while tags are connected to batteries, therefore the LMD's are able to transmit to a greater range than the tag. In another embodiment of the present invention a tag may also be programmed to react and act as an LMD and as a Tag. The Tag may communicate with other tags and may communicate with LMDs. In an alternative embodiment the LMDs are battery powered. Powered batteries can include ordinary batteries or rechargeable batteries, which can be located at large scale events, larges scale construction sites, large facilities, underground trains, airports and other designated areas. Because the LMD may include a larger antenna the transmission/reception ranges between the LMDs are larger then those of the tag and are determined by the transmission range of the LMD's. Moreover, LMD's 1 through 4 may be connected to CMS 402 via dedicated separate communication lines designated 405, 407, 409 and 411 respectively via telephony switchboard 450. A person 440 wearing an RF transmitting tag 444 is also depicted in FIG. 4 located in shared RF reception range 416 and 418 of LMD3 408 and LMD4 410 respectively. LMDs 1 through 4 characteristically located in special region of interest such as the monitored person's residency and/or work place, banks, stores, train station, bus stations, airports, central road intersections etc. LMD 1 through LMD 4 respective RF reception ranges overlap due to their proximity. In reality an effective RF reception range can range between about 100 and 500 meters depending on many factors such as LMD transmitter/receiver parameters, transmitting tag parameters, terrain type, housing density, housing types and size, as well as other factors. Enhanced LMDs may have a larger reception range which may reach even 1000 meters or more. The RF reception is mainly dependant on the level power of transmission and the sensitivity of the receiving device. Reception and transmission can therefore be adjusted accordingly to fit the requirements of the system and the particular user of the system. A large numbers of local monitoring devices in a specific area can permit better collective reception area for the system due to overlap of reception ranges. RF reception range 412 of LMD1 404 overlap RF reception range 414 of LMD2 406 that also overlap with RF reception range 416 of LMD3 408. RF reception range 416 of LMD3 408 overlap with reception range 414 of LMD2 406 that also overlap with reception range 418 of LMD4 410. In one mode of operation as described previously in FIG. 3, each LMD 404, 406, 408 and 410 communicates bi-directionally with CMS 402 directly via communication lines 405, 407, 409 and 411 via telephony switchboard 450. Only one switchboard 450 is depicted in FIG. 4 for sake of clarity, however it should be clear to the person skilled in the art that telephone lines connecting LMD's to CMS can rout through many different switchboards and by no means travel through the same path. Telephony lines can be over crowded due to systems communication as well as due to other transmissions on the same routes due to other communications. In addition, phone lines, relays and switchboards along the path connecting between an LMD and CMS cannot be disconnected or be disrupted. Messages and data transmitted from LMD to CMS and from CMS to LMD routed preferably via telephone landline, can be routed such that a massage sent from the CMS to an LMD connected to a disconnected or overcrowded telephone line can be routed. The rerouting is performed by sending a massage or data from the CMS to a different LMD via telephone line and from such location to the target LMD via RF transmission. This can circumvent telephony line overload by bypassing overloaded telephone lines routes and using less crowded lines and then RF transmission. This can also facilitate LMD data transfer to CMS even when some telephone lines are down, or used in other situations predefined by the CMS such as in the fear of tamper, eavesdropping or tapping, etc. In FIG. 4 arrows 430, 432 and 434 symbolize data transmission in RF from one LMD to another In FIG. 4 LMD1 404 and LMD2 406 having overlapping RF transmission range can transmit RF signals and data 430 to each other. The same can be applied to LMD2 406 and LMD3 408 as well as LMD3 408 and LMD4 410. RF signals and data cannot however be transmitted to LMD's found outside the transmission/reception range. For example, data and messages cannot be transmitted from LMD4 410 to LMD1 404 because no shared RF transmission/reception range exist between them. Indirect communication between LMD1 to LMD4 however is possible through transfer of LMD1 transmissions from LMD1 to LMD 2 and from LMD2 to LMD4. Thus, if LMD1 404 connection 405 to CMD 402 is inoperative or cannot be established, but LMD4 connection 411 to switchboard 450 and CMS 402 is viable than the transfer of transmissions between LMD1 to LMD2 and from LMD2 to LMD4 and than to CMS 402 via connection 411 and switchboard 450 can provide an alternative manner of transferring LMD1 transmissions to CMS 402. This manner of operation is of particular importance because LMD1 may provide crucial information about the location of monitored persons in real time to CMS 402 even if it is not directly connected to CMS 402.

One possible and non-limiting example illustrating one possible use of the features described in the context of the present invention includes a rule-defining event stored in memory device (not shown) of LMD4 410. Such a rule precludes person 440 wearing RF transmission tag 444 to enter RF reception range 418. In addition, in the present example telephone line 411 is inoperative. When Person 440 is within RF reception range 418 of LMD4 410 and tag 444 is transmitting RF data, LMD4 410 receives tag 444 ID and adds time stamp. LMD4 410 then compares ID code and time stamp with rules therewithin. The disagreement of tag 444 location and rules prompt an event. The event requires that LMD4 410 will contact CMS and report. LMD4 410 then tries to connect with CMS 402 via telephone line 411. Following a repeated failure, due to telephone line operation failure, LMD4 410 transmit message information containing tag ID 444 and time stamp, other tag related information, event prompting connection, telephone line connection trial failure and self ID and time stamp via RF signal to LMD3 408. LMD3 408 relays this information after adding own ID and time stamp via a communication line 409 to CMS 402. The communication line can also be a cellular communication line or a wide or local area network based on TCP/IP and the like. Thus, the capability to route information via RF provides flexibility, and credibility to system 400. The geographical localization of a person wearing an RF tag can be accomplished by the analysis of signal strength emanating from the tag. The Received Signal Strength Indication (RSSI) provides an additional data, namely the distance from the LMD, to be taken into account when the location of the monitored person is determined. However, the limitation of such an analysis is that the RSSI signal gives information regarding distance but not bearing. For a superior accurate localization two or more readings from different receiving LMD's are required.

In FIG. 4 person 440 having RF transmitting tag 444 is within both reception range of LMD4 410 and reception range of LMD3 408. When LMD4 410 receives an RSSI from tag 444, LMD4 410 can approximate the distance of tag 444 from LMD4 410 and therefore can determine that person 440 is located along line 480 but not the exact location. When LMD3 408 receives an RSSI from tag 444, LMD3 408 can localize person 440 along line 482 but not the exact location. LMD3 408 can identify the approximate distance (on the radius) where person 440 is located but not the direction. Using the RF transmission capability mentioned hereinabove, LMD3 408 and LMD4 410 exchanged the RSSI readings such that both LMD's 408 and 410 can isolate person 440 position along intersection lines 480 and 482, thus narrowing person 440 location. The localization calculation can alternatively be performed at CMD 402 after receiving time stamped data from both LMD4 410 and LMD3 408, thus in effect RF transmissions between said LMD's becomes redundant. It can be easily appreciated that localization accuracy increases as person tag is received by more LMD's. Thus, increase number of overlapping LMD's not only allows better coverage and data transmission but also geographical localization of monitored persons.

The persons tracking and monitoring system of the present invention can be used in association with GPS-wireless tracking systems. For example, when satellite coverage for geographical localization is inadequate, tags of the GPS-wireless tracking system, also using RF signals, can be enslaved to the present tracking and monitoring system such that localization and monitoring can be realized. Such tags can be modified to constantly work with the present system for backup purposes as well as for the reduction of GPS device usage that is power consuming.

Turning now to FIG. 5 where a schematic illustration of data displayed at the central monitoring system of the present invention in a tabulated form is illustrated and where tabulated data 500 is typically displayed on a computer screen but can also be displayed on a TV screen as well as any other display device known in the art. Table 500 is one non-limiting example of the possible data summarization forms that can be realized using specialized software program for managing information received from LMD's. In addition, other information can be presented. Such data can be derived from hand held reset devices, telephone company, law enforcement agency as well as other parties connected to the CMS.

Table 500 displays data concerning the whereabouts of different persons according to their respective tags. Column 502 of Table 500 is named TAG-ID and displays there below the different Tag identification codes such as TAGx 510, TAGy 512, TAGz 514 TAGz+1 516 and so forth. Column 504 named LMD-ID displays there below the local monitoring device identification (ID) code relaying the information regarding tags. The LMD-ID code can be numeral such as LMD1 518, LMD2 522, LMD3 526 or any other form of ID code such as LMD at location x etc. Column 506 named TIME STAMP display there below time stamp imprinted at the LMD at time of tag ID reception or at time of event occurrence within reception range of appropriate LMD. For example, TAGx 510 received by LMD1 518 at time1 520, by LMD2 522 at time2 524 and by LMD3 526 at time3 528. The same applies to the other tags illustrated in table 500. Table 500 can supply additional data. For example, FIG. 5 shows that the person wearing TAGy 512 was within reception range of LMD3 526 and LMD2 526 at the same time 520 such that more accurate localization of that person at time 520 can be acquired. Additional information such as street name and number regarding exact location of person wearing TAGy can be prompted by monitoring personnel (not shown). In addition, person wearing TAGy 512 was located with person wearing TAGx 510 within reception range of LMD3 526 at the same time (time stamp3 528). Given a more specific time stamping, neglected here for simplicity, the probability of association between persons can be established from these readings alone. This information can also be prompted for the interest of monitoring personnel (not shown). Column 508 named OTHER displays therebelow any special events prompting the reporting or saving of data such as pushing a panic button (PANIC 560), tampering with the tag (TAMPER 580) as well as device related information such as tag battery low (TAG BAT LOW 570), communication line unavailability (NO LINE 590) etc.

Other forms of table 500 can be realized such as a table showing persons name, address, prior offenses, temporal and spatial restrictions as well as other information regarding the person whereabouts. Alternatively monitoring personnel may choose to view exclusion zones: bars for alcoholics, schools for sex offender, and the like, information regarding events or suspected rendezvoused with other persons or victims neglecting other less relevant data. Yet another display view may include tag or LMD status. Yet another display option can include display representation from a specific or a group of LMD's point of view, according to specific time stamping etc. Yet another option can involve the tracking of person path and displaying abnormalities as of to a known daily routine. Other graphical forms of display not mentioned such as pie, columns, and other forms can be realized within the scope of the present invention.

Figure 6:
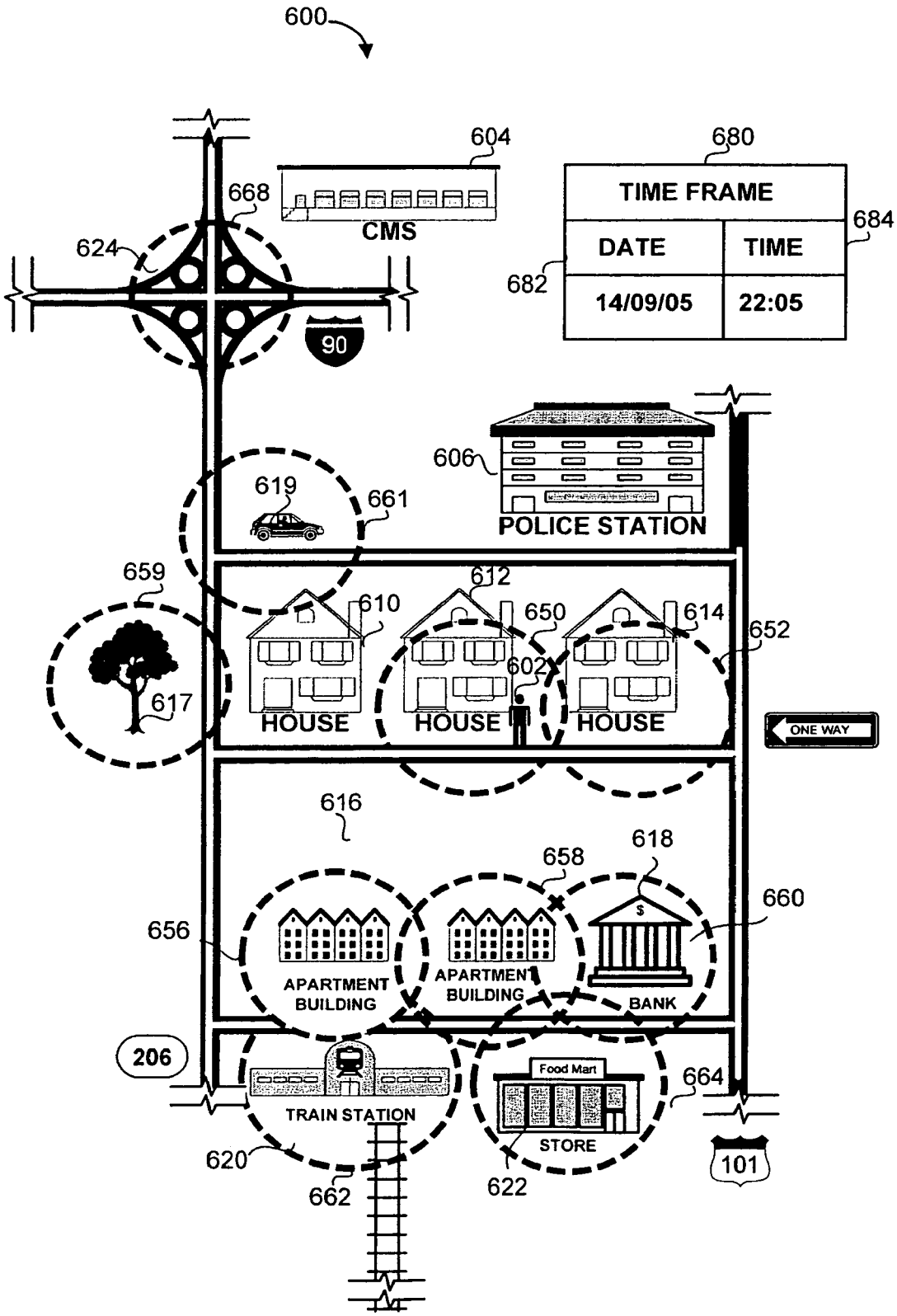
FIG. 6 is a schematic illustration of data displayed at the central monitoring system of the present invention in a schematic map form.

Turning now to FIG. 6 where schematic illustration of data displayed at the central monitoring system of the present invention in a map form is illustrated and where the map is designated 600. FIG. 6 also illustrates the various locations where LMDs 110 of the previous figures may be located externally to the monitored perosn's home or also in various other locations. The present and previous figures should be read in conjunction with the use of Tags as LMDs and that tags may communicate with each other. Map 600 illustrates typical urban surroundings having specific locations where local monitoring devices can be positioned for the tracking and monitoring of persons. Such locations include houses 610, 612 and 614, apartment building 616, trees 617, bank 618, vehicles 619 (which can include all types of vehicles including cars, trains, airplanes and the like), train station 620 or other locations of mass transport such as airports, bus depots and the like, store 622 as well as road intersection 624 or other locations along roads and highways, and the like. The monitoring devices can be located and installed in a multitude of locations depending primarily on coverage requirements and power supply ability. Power supply to mobile devices can be accomplished via the use of batteries, rechargeable batteries, vehicle power systems, solar panels (either for direct power supply or recharging of rechargeable batteries) and the like. In a number of those locations personnel installed local monitoring devices (not shown) having RF reception ranges such that person 602 as well as other persons (not shown) can be tracked through multiple locations. The monitoring devices, such as LMDs can be located in fixed or mobile locations. If installed in mobile locations the initial location of the vehicle is fed into the central monitoring system and additional location determination devices are installed to track the monitoring device. Such can include a global positioning system receiver having the ability to provide location information or a connection to the vehicle's odometer and steering wheel enabling the tracking of the vehicle's movement. Once the mobile LMD's movements can be ascertained, then the relative position of vehicle 619 and the RF reception range can be established. RF reception ranges (RFRR) of local monitoring devices depicted in FIG. 6 include RFRR 650 in and around house 612, RFRR 652 in and around house 614, RFRR 656 and 658 in and around parts of apartment building 616, RFRR 659 in and around tree 617, RFRR 660 in and around bank 618, RFRR 661 in and around vehicle 619, RFRR 662 in and around parts of train station 620, RFRR 664 in and around store 622, RFRR 668 in and around road intersection 624. Some of the RFRR's have overlapping reception ranges such as RFRR 650 and 652, RFRR 658, 660 and 664 as well as others. Reception ranges may overlap at times when mobile LMDs are used. This reception range overlap is useful in the location determination of a person as previously described in FIG. 4. Additional monitoring devices enable the various reception ranges to overlap and allow greater ability (enhanced resolution) to determine the location of a monitored person. Other local monitoring devices can be installed in other sites. A large number of local monitoring devices increase coverage and localization potential of the system. Although not illustrated in FIG. 6, a communication line connects all locales having a local monitoring device (not shown) installed as well as most other locales. The communication line can be a telephone line, a cellular communication lines, a local or wide area network or the like. In the present example a telephone line is used as the non-limiting example of a communication line. A telephone line can be installed in area not normally containing such line such as road intersection 624. Alternatively other forms of communication between local monitoring devices generating RFRR 668 can be employed as previously described. Map 600 shown to monitoring personnel within CMS 604 also represented on the map is used to graphically track and monitor person 602 as well as other persons. Map 600 can be configured to show person 602 locations at any particular time according to information received from LMDs situated at the various locations in the area monitored. A time frame indication 680 displays the date 682 and time 684 of data presently displayed on the map. The time frame will update as time passes and the location of the person 602 is updated. The display is provided in real time and the officer or person monitoring the system will see the actual movement of the person 602 monitored. Other information can be displayed on the map such as person's 602 personal information, tag information, rules and regulations pertaining to the person monitored, person history, potential victim current location as well as other multitude of information related to the persons tracking and monitoring system. Map 600 can also be viewed in a zoom in and zoom out modes such that greater detail of map can be viewed. Map 600 can also show person 602's track in a course of time prior to current time such that the route a person takes can be viewed graphically. This route can also be crossed referenced against other persons' routes as well as victims paths and other monitored personnel paths based on systems information. CMS 604 and Police station 606 can also be monitored and display. Monitoring these locales can add information to the system such as probation officer visitation times and the like. Map 600 can also display city subway, bus, tramway lines as well as other transportation means and routes for faster tracking of persons. LMDs may be installed in trains, buses, taxis and other transportation vehicles. Other map like display as well as other display forms known in the art can be used with the present invention. In an alternative embodiment the CMS device does not include a display device and all functions are performed automatically without the aid of persons. In this alternative embodiment the data such as map 600 is not displayed; rather the CMS 604 performs analysis of the locations of the monitored persons and according to a predefined set of rules provides alerts to law enforcement officers. The predefined set of rules may include such rules as "notify office X if offender Y is detected in zone 660" or "notify officer <ID> if offender Y is detected in the same zone as offender T" and the like. The persons skilled in the art will appreciate the many modifications that could be accomplished with the system of the present invention. The system of the present invention enables the unique identification of offenders in accordance with locations other than the LMD located at the home of the offender. As shown in association with FIG. 6 the LMDs located in various other areas may be used to identify the movements and locations of the offender. Rules provided to the CMS are continuously checked by the CMS in relation to data received from the LMDs. Once an offender is in breach of a rule and is found to be outside the area of his allowed locations or inside a disallowed location an alert is issued.

The person skilled in the art will appreciate that what has been shown is not limited to the description above. The person skilled in the art will appreciate that examples shown here above are in no way limiting and are shown to better and adequately describe the present invention. Those skilled in the art to which this invention pertains will appreciate the many modifications and other embodiments of the invention. It will be apparent that the present invention is not limited to the specific embodiments disclosed and those modifications and other embodiments are intended to be included within the scope of the invention. Although specific terms are employed herein, they are used in a generic and descriptive sense only and not for purposes of limitation. Persons skilled in the art will appreciate that the present invention is not limited to what has been particularly shown and described hereinabove. Rather the scope of the present invention is defined only by the claims, which follow.

I/we claim:

1. A wide area monitoring and tracking system for monitoring and tracking a plurality of individuals, the system comprising:

a computerized central monitoring server comprising a processor for processing data, a memory device for storing data and a display device for displaying data;

a plurality of transmitting tags attachable to monitored individuals, each having a unique identification code, each of the plurality of tags includes a transmitter which periodically broadcasts a signal carrying a first data regarding the individual to whom the tag is attached, the first data includes the tag's identification code; and a plurality of local monitoring devices distributed at predetermined locations, each of the plurality of local monitoring devices comprises a receiver receptive to signals transmitted from any of the plurality of tags when a tag is within reception range of a local monitoring device, a data processor for processing the first data carried by said signals, a memory device, and a communication device for communicating according to predefined schedule a second data to the central monitoring server, the second data includes all or part of the first data and additional data concerning identity and status of the local monitoring device communicating the second data;

wherein the central monitoring server processes the data communicated from the plurality of local monitoring devices to obtain information regarding the plurality of monitored individuals and further manipulates the information for tracking monitored individuals by collecting information concerning a particular monitored individual received from different local monitoring devices.

2. The system of claim 1 wherein the transmitting tags further include a receiver.

3. The system of claim 1 wherein the predetermined locations include locations associated with each of the plurality of monitored individuals and wherein a local monitoring device located at a location associated with a specific monitored individual includes within its memory device a set of rules regarding presence and absence of said specific monitored individual within the reception range of the local monitoring device.

4. The system of claim 3 wherein upon violation of said rules by said specific monitored individual, a message is sent to the central monitoring server.

5. The system of claim 3 wherein the locations associated with the monitored individuals include residence or work locations of the monitored individuals or other locations where the monitored individuals perform private or public activities.

6. The system of claim 3 wherein the predetermined locations further include public locations not associated with a particular monitored individual.

7. The system of claim 1 wherein the predetermined locations include any of the following: the home of a monitored person, an office, a public establishment, a public road, a public area, a vehicle.

8. The system of claim 1 wherein the predetermined locations include locations external to the monitored person's home.

9. The system of claim 1 wherein the transmitter is a single or multiple channel RF transmitter.

10. The system of claim 1 wherein the local monitoring devices include mobile monitoring devices.

11. The system of claim 1 wherein at least one of the local monitoring devices is installed in a vehicle.

12. The system according to claim 1 wherein the obtained information is displayed graphically in a map.

13. The system of claim 1 wherein the transmitting tags further include anti-tamper mechanism for indicating attempts to remove and/or to damage the tag and wherein the first data carried by the transmitted signals include data concerning tamper attempts.

14. The system of claim 1 wherein the local monitoring devices further include tamper evidence mechanism indicating attempts to remove or to damage the local monitoring device and wherein upon such an attempt a message is sent to the central monitoring server.

15. The system of claim 1 wherein the communication device of the local monitoring device for communicating the second data to the central monitoring server comprises a telephone line or a cellular telephone network or a data network or a telecommunication signal network.

16. The system of claim 15 wherein the telephone line is a dedicated line.

17. The system of claim 1 wherein the communication device of the local monitoring device for communicating the second data to the central monitoring server comprises a local or wide area network.

18. The system of claim 1 wherein a local monitoring device further includes a transmitter capable of broadcasting signals receptible by other local monitoring devices having overlapping reception/transmission range with the local monitoring device.

19. The system of claim 18 wherein upon failure of communication between the communication device of a local monitoring device and the central monitoring server, the local monitoring device broadcasts the second data via the transmitter to be relayed to the central monitoring server by other local monitoring devices.

20. The system of claim 1 wherein at least one transmitting tag communicates with at least another transmitting tag.

21. A wide area monitoring and tracking method for monitoring and tracking a plurality of individuals, the method comprising:

providing each of the plurality of individuals to be monitored with an attachable transmitting tag, each of the plurality of tags periodically broadcasting a signal carrying a first data regarding the individual to whom the tag is attached, the first data includes the tag's identification code;

distributing a plurality of local monitoring devices at predetermined locations, each of the plurality of local monitoring devices receiving signals transmitted from any of the plurality of tags when a tag is within reception range of a local monitoring device;

processing at the local monitoring devices the first data carried by said signals;

communicating from the local monitoring devices according to predefined schedule a second data to a central monitoring server, the second data includes all or part of the first data and additional data concerning identity and status of the local monitoring device communicating the second data; and processing at the central monitoring server the data communicated from the plurality of local monitoring devices to obtain information regarding the plurality of monitored individuals and manipulating the information for tracking monitored individuals by collecting information concerning a particular monitored individual received from different local monitoring devices.

22. The method of claim 21 wherein the transmitting tags further include a receiver.

23. The method of claim 21 wherein the predetermined locations include locations associated with each of the plurality of monitored individuals and wherein a local monitoring device located at a location associated with a specific monitored individual includes within its memory device a set of rules regarding presence and absence of said specific monitored individual within the reception range of the local monitoring device.

24. The method of claim 23 wherein upon violation of said rules by said monitored individual, a message is sent to the central monitoring server.

25. The method of claim 23 wherein the locations associated with the monitored individuals include residence or work locations of the monitored individuals.

26. The method of claim 23 wherein the predetermined locations further include public locations not associated with a particular monitored individual.

27. The method of claim 21 wherein the predetermined locations include any of the following: the home of a monitored person, an office, a public establishment, a public road, a public area, a vehicle.

28. The method of claim 21 wherein the predetermined locations include locations external to the monitored person's home.

29. The method of claim 21 wherein at least one of the local monitoring devices is installed in a vehicle.

30. The method of claim 21 wherein a local monitoring device broadcasts signals receptible by other local monitoring devices having overlapping reception/transmission range with the local monitoring device.

31. The method of claim 21 wherein at least one transmitting tag communicates with at least another transmitting tag.

32. A wide area monitoring and tracking system for monitoring and tracking a plurality of individuals, the system comprising:

a computerized central monitoring server comprising a processor for processing data, a memory device for storing data and a display device for displaying data;

a plurality of transmitting tags attachable to monitored individuals, each having a unique identification code, each of the plurality of tags includes a transmitter which periodically broadcasts a signal carrying a first data regarding the individual to whom the tag is attached, the first data includes the tag's identification code; and a plurality of local monitoring devices distributed at predetermined locations, the predetermined locations include locations external to the monitored individuals' homes, each of the plurality of local monitoring devices comprises a receiver receptive to signals transmitted from any of the plurality of tags when a tag is within reception range of a local monitoring device, a data processor for processing the first data carried by said signals, a memory device, and a communication device for communicating according to predefined schedule a second data to the central monitoring server, the second data includes all or part of the first data and additional data concerning identity and status of the local monitoring device communicating the second data.

33. A wide area monitoring and tracking method for monitoring and tracking a plurality of individuals, the method comprising:

providing each of the plurality of individuals to be monitored with an attachable transmitting tag, each of the plurality of tags periodically broadcasting a signal carrying a first data regarding the individual to whom the tag is attached, the first data includes the tag's identification code;

distributing a plurality of local monitoring devices at predetermined locations, the predetermined locations include locations external to the monitored individuals' homes, each of the plurality of local monitoring devices receiving signals transmitted from any of the plurality of tags when a tag is within reception range of a local monitoring device;

processing at the local monitoring devices the first data carried by said signals;

communicating from the local monitoring devices according to predefined schedule a second data to a central monitoring server, the second data includes all or part of the first data and additional data concerning identity and status of the local monitoring device communicating the second data.

* * * * *